US005431618A

United States Patent [19]

Levi

[11] Patent Number: 5,431,618

[45] Date of Patent: Jul. 11, 1995

[54] EXERCISING DEVICE

[76] Inventor: Efim Levi, 150 S. Gardner St., Los Angeles, Calif. 90036

[21] Appl. No.: 201,366

[22] Filed: Feb. 24, 1994

[51] Int. Cl.[6] ..... A63B 26/00; A61F 5/00

[52] U.S. Cl. ..... 482/142; 482/148; 5/633; 606/240

[58] Field of Search ..... 482/142, 140, 148; 5/633, 634; 606/240

[56] References Cited

U.S. PATENT DOCUMENTS

| | | | |
|---|---|---|---|
| 1,869,460 | 8/1932 | Brand | 606/240 |
| 3,555,582 | 1/1971 | Radford | 5/633 |
| 3,601,121 | 8/1971 | Roberts | 5/633 |
| 4,189,182 | 2/1980 | Rhee | 5/633 |
| 4,475,542 | 10/1984 | Brossard | 606/240 |

*Primary Examiner*—Richard J. Apley

*Assistant Examiner*—Lynne A. Reichard

*Attorney, Agent, or Firm*—Poms, Smith, Lande & Rose

[57] ABSTRACT

An exercising device of an overall length relating to the length of an exercising person lying prone thereon and of a width relating to the width of an exercising person. The device has a first section having a concave portion for accommodating the back of the exercising person, a second mid section having a convex portion of an overall height greater than the first section for accommodating the body portion of an exercising person between the gluteus maximus and the lower back portion of an exercising period and a third section having a convex portion of an overall height greater than the second section for accommodating the rear knee portion of an exercising person, the second section being spaced from the third section by a concave portion for supporting the gluteus maximus of an exerciser.

3 Claims, 1 Drawing Sheet

EXERCISING DEVICE

BACKGROUND OF THE INVENTION

FIELD OF THE INVENTION

The invention relates to exercising devices; and, more particularly, to an exercising device wherein an exercising person can lay on his or her back on the device and protect their lower spine from injury during leg raises.

DESCRIPTION OF THE PRIOR ART

Various types of exercising devices are known in the art. None of these exercising devices allow exercisers to lie on their backs with their gluteus maximum resting in a concave portion and their legs over a forward convex portion, head to the rear. Such a device is needed to allow an exerciser to do leg raises and develop his or her's lower and midabdominal musculature safely and effectively while protecting their lower spine from injury.

There is thus a need for such an exercising device which is quick and easy to set up, portable, and can be inexpensively manufactured.

SUMMARY OF THE INVENTION

It is an object of this invention to provide an exercising device for doing situps.

It is a further object of this invention to provide an exercising device wherein an exerciser can lie prone on his or her back on the device with their gluteus maximum in a concave portion of the device and their head at one end and their feet extending over a convex potion of the device.

It is still further an object of this invention to provide an exercising device in accordance with the foregoing objects which is of one piece and portable.

These and other objects are preferably accomplished by providing an exercising device in the form of a cushion of an overall length relating to the length of an exercising person lying prone thereon and of a width relating to the width of an exercising person. The device has a first section having a concave portion for accommodating the back of the exercising person, a second mid section having a convex portion of an overall height greater than the first section for accommodating the body portion of an exercising person between the gluteus maximus and the lower back portion of an exercising person and a third section having a convex portion of an overall height greater than the second section and for accommodating the rear knee portion of an exercising person, the third section being spaced from the second section by a concave portion for supporting the gluteus maximus of the exerciser. The device may be resilient, portable, and of one piece. An exerciser rests his or her gluteus maximus in the concave section between the second and third section and drapes his or her legs over the third section so as to do leg raises on the device without injury to the lower spine.

The cushion or device protects the lower spine from injury during leg raises. It optimizes and intensifies the use of lower and midabdominal musculature safely and effectively. It allows one to do more repetitions and to develop lower and midabdominal musculature safely and effectively. The cushion or device enables one to increase the number of repetitions and to develop lower and midabdominal musculature with maximum efficiency and safety. The design of the cushion or device allows the coccyx and lower lumber spine to comfortably rest on the cushion or device thereby eliminating the stress, irritation, or injury to the lower back which otherwise often results during such exercises.

DESCRIPTION OF THE PREFERRED EMBODIMENT

Figure 1:
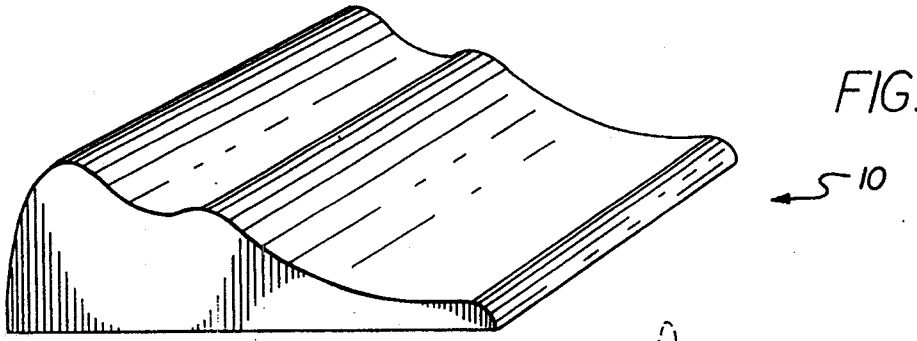
FIG. 1 is a perspective view of the exercising device of the invention.
Figure 2:
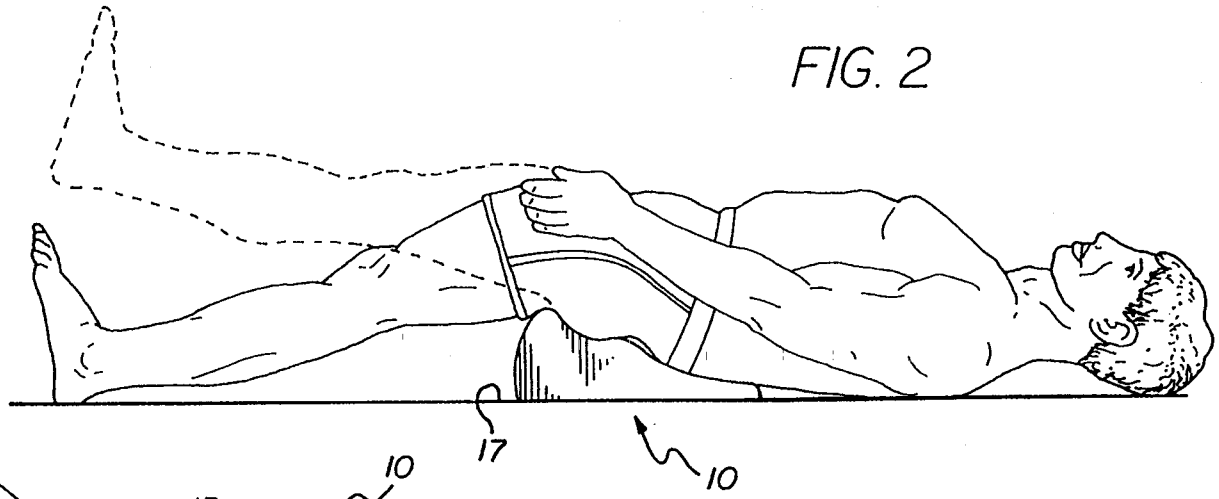
FIG. 2 is a side elevational view of the device of FIG. 1 showing an exerciser lying prone thereon on his or her back.
Figure 3:
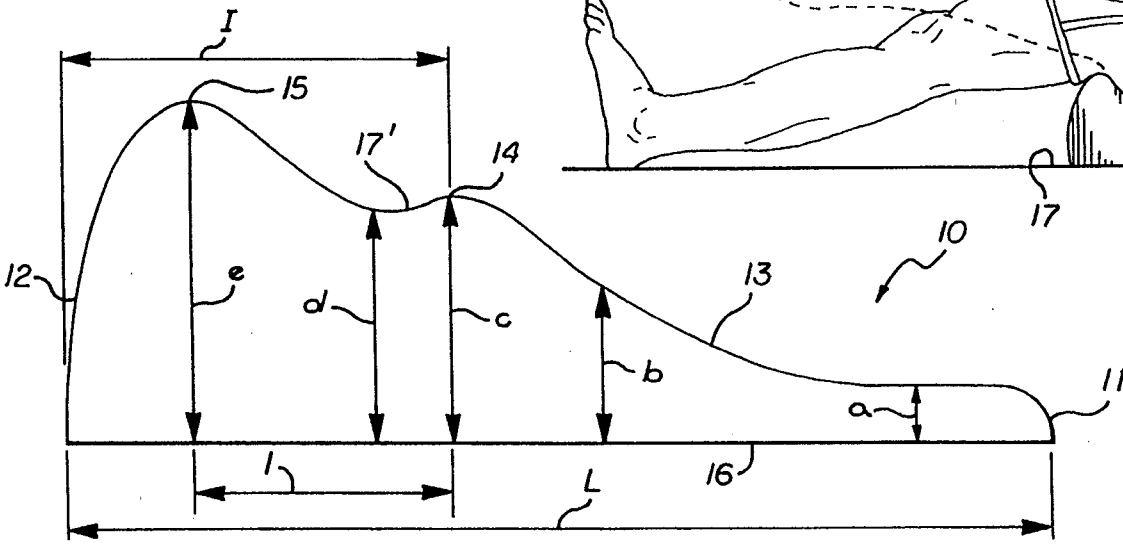
FIG. 3 is a side view of the device of FIG. 1.

Referring now to FIG. 1 of the drawing, an exercising device 10 is shown in the preferred form of a cushion having an overall width of about 16½". As seen in FIG. 2, and comparing the same with FIG. 1, device 10 extends from a first forward end 11 to a second rearward end 12. Device 10 is divided therealong into a plurality of integral sections. Thus, a first concave section 13 is provided for supporting the back of an exerciser as seen in FIG. 2. Section 13 tapers gradually from end 11 and upwardly to a second convex section 14 (see also FIG. 1) of a height substantially greater than that of first section 13. Second section 14 tapers downwardly, then upwardly to form a third convex section 15. Section 15 then extends downwardly forming forward end 12 and terminating at bottom wall 16. Bottom wall 16 is flat and rests on supporting surface 17. Convex section 15 is slightly higher or greater in overall height than section 14 and is separated from section 14 by a concave area 17'.

As seen in FIG. 2, the overall length L of device 10 is about 12¾" the height of device 10 adjacent end 11 is about ¾". The height h of device 10 at about the midpoint of concave section 13 is about 2". The height c of convex section 14 is about 3¼". The height d of concave section 17' is about 3". The height e of convex portion 15 is about 4½". The length I between end 12 and point c is about 5". The length l between line e and line c is about 3¾".

These dimensions are preferred and of course may vary. However, such dimensions would accommodate an average size man or women. Device 10 may be made in smaller sizes for children. Any suitable materials may be used. Preferably, device 10 is of a resilient material, such as rubber or any suitable plastic material and may be molded and of one unitary piece.

Thus, device 10 is light weight, easy to manufacture and use, and portable. As seen in FIG. 2, the exerciser lies on his or her back with their gluteus maximus disposed in concave area 17' and their legs extending over convex section 15 and outwardly. Please note that the exerciser's back rests in concave section 13. Thus, the exerciser can do leg raises on device 10 as seen in dotted lines and thus develop their lower and midabdominal musculature safely and effectively while protecting their lower spine from injury. Obviously, other parts of the body will be subject to exercise at the same time.

Although a particular embodiment of the invention is disclosed, variations thereof may occur to an artisan and the invention is to be limited only by the scope of the appended claims.

I claim:

1. An exercising device of a resilient material comprising:

a main body portion having a width, a length and a generally flat base, a front end wall extending generally upwardly from said base and a rear end wall extending upwardly from said base and spaced from said front end wall;

a first concave section extending from said front wall rearwardly toward said rear wall to a first convex section, of an overall height greater than said first concave section;

a second convex section spaced from said first convex section and separated therefrom by a second concave section, said second convex section being of an overall height greater than the overall height of said first convex section, said second convex section tapering into said rear end wall whereby an exerciser may lay prone on his or her back on said device with his or her gluteus maximus disposed in said second concave section with the legs of the exerciser extending over said second convex section past said rear end wall, the overall width of said device being about 16½" and the overall length of said device being about 12¾" the height of substantially the middle of said second convex section being about 4½" the height of substantially the midpoint of said second concave section being about 3", the height of substantially the midpoint of said first convex section being about 3¼" and the height of said first concave section being about ¾" high adjacent said end wall and extending therefrom to said first convex section, said second convex section curving from said second concave section to a maximum height, then curving at its maximum height forming a rounded dome that tapers down to said rear end wall.

2. In the device of claim 1 wherein said device is of rubber.

3. In the device of claim 1 wherein the distance between the rear end wall and the maximum height of said first convex section is about 5".

* * * * *